US006632378B1

(12) United States Patent
Wallace, II et al.

(10) Patent No.: US 6,632,378 B1
(45) Date of Patent: Oct. 14, 2003

(54) NITRATE ESTER PLASTICIZED ENERGETIC COMPOSITIONS, METHOD OF MAKING AND ROCKET MOTOR ASSEMBLIES CONTAINING THE SAME

(75) Inventors: Ingvar A. Wallace, II, Brigham City, UT (US); Jeffery Oyler, Tremonton, UT (US)

(73) Assignee: Alliant Techsystems Inc., Edina, MN (US)

( * ) Notice: Subject to any disclaimer, the term of this patent is extended or adjusted under 35 U.S.C. 154(b) by 205 days.

(21) Appl. No.: 09/797,929

(22) Filed: Mar. 2, 2001

Related U.S. Application Data

(60) Provisional application No. 60/186,757, filed on Mar. 3, 2000.

(51) Int. Cl.[7] ..... C06B 45/10; C06B 45/36; C06B 45/18; C06B 31/12; C06B 43/00

(52) U.S. Cl. ..... 252/182.24; 252/182.2; 252/182.22; 149/3; 149/10; 149/11; 149/12; 149/19.1; 149/19.4; 149/19.91; 102/285; 102/287; 102/289; 523/180; 244/74; 60/219

(58) Field of Search ..... 252/182.24, 182.22, 252/182.2; 523/180; 102/285, 287, 289; 149/3, 10, 11, 12, 19.1, 19.4, 19.91; 244/74; 60/219

(56) References Cited

U.S. PATENT DOCUMENTS

| | | | | |
|---|---|---|---|---|
| 2,706,189 A | | 4/1955 | Pruitt et al. | |
| 3,004,840 A | | 10/1961 | Pruitt et al. | |
| 3,529,042 A | * | 9/1970 | Lippert et al. | 264/3.1 |
| 3,725,152 A | | 4/1973 | Niles et al. | |
| 3,846,195 A | | 11/1974 | Zimmerman et al. | |
| 3,870,578 A | | 3/1975 | Nichols, Jr. | |
| 4,018,636 A | | 4/1977 | O'Neill et al. | |
| 4,243,760 A | | 1/1981 | McDaniel et al. | |
| 4,358,327 A | | 11/1982 | Reed, Jr. et al. | |
| 4,638,735 A | | 1/1987 | Lelu et al. | |
| 4,799,980 A | * | 1/1989 | Reed, Jr. | 149/19.4 |
| 5,067,996 A | * | 11/1991 | Lundstrom et al. | 49/19.4 |
| 5,076,868 A | | 12/1991 | Doll et al. | |
| 5,527,498 A | | 6/1996 | Kelley | |
| 5,597,977 A | | 1/1997 | Chattopadhyay | |
| 5,925,846 A | | 7/1999 | Richard et al. | |
| 6,051,087 A | | 4/2000 | Hutchens et al. | |
| 2001/0047072 A1 | * | 11/2001 | Sanderson et al. | 528/78 |

OTHER PUBLICATIONS

R.J. Tuinman et al., Ultra Soft Polyurethane Cast Elastomers, Polyurethanes Expo '98, pp. 535–542 (Sep. 17–20, 1998).

* cited by examiner

*Primary Examiner*—Mark Kopec
*Assistant Examiner*—Kallambella M Vijayakumar
(74) *Attorney, Agent, or Firm*—TraskBritt

(57) ABSTRACT

A nitrate ester plasticized energetic composition in which the binder is made of, prior to curing, lower alkylene glycol prepolymer blocks end-capped with ethylene glycol monomers and/or oligomers. The end-capped prepolymer blocks are preferably difunctional or trifunctional. The lower alkylene glycol are preferably propylene glycol, butylene glycol, and/or copolymers thereof. The difunctional end-capped alkylene glycol prepolymer blocks are cured with a diisocyanate or polyisocyanate. In the case of a trifunctional (or higher functional) end-capped alkylene glycol prepolymer block, preferably a diisocyanate is used to effect crosslinking.

30 Claims, 1 Drawing Sheet

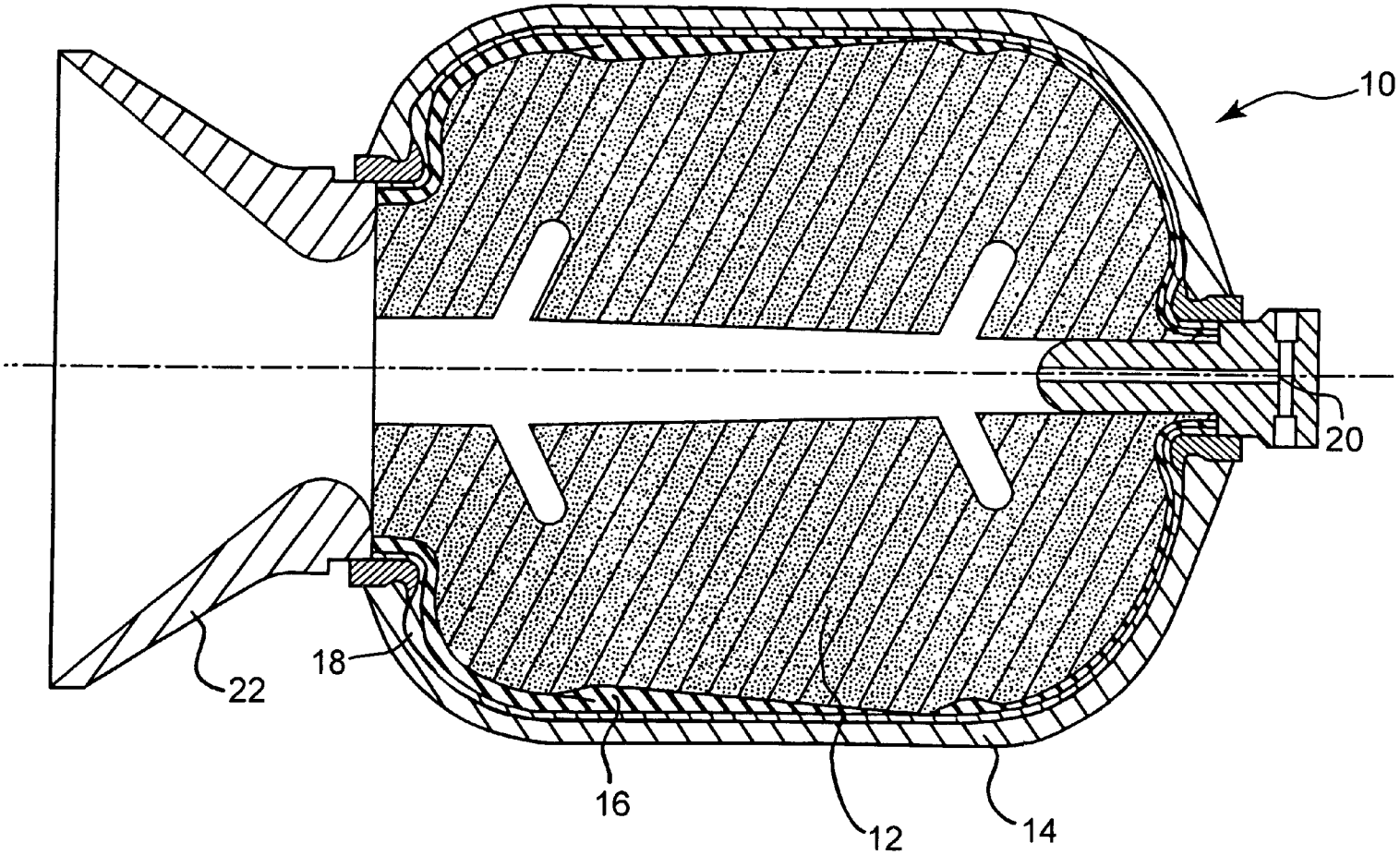
10
20
14
12
16
18
22

NITRATE ESTER PLASTICIZED ENERGETIC COMPOSITIONS, METHOD OF MAKING AND ROCKET MOTOR ASSEMBLIES CONTAINING THE SAME

CROSS-REFERENCE TO RELATED APPLICATION

The benefit of priority of claimed of U.S. Provisional Application No. 60/186,757 filed in the U.S. Patent & Trademark Office on Mar. 3, 2000, the complete disclosure of which is incorporated herein by reference.

GOVERNMENT LICENSING CLAUSE

The U.S. Government has a paid-up license in this invention and the right in limited circumstances to require the patent owner to license others on reasonable terms as provided for by the terms of contract N68936-97-C-0268 awarded by the Naval Air Warfare Center (NAWC).

BACKGROUND OF THE INVENTION

1. Field of the Invention

This invention is directed to nitrate ester plasticized energetic compositions, and in particular a nitrate plasticized energetic composition comprising a binder that is highly compatible with nitrate esters. This invention is further directed to a method of making the energetic composition, and a rocket motor assembly loaded with the propellant comprising the energetic composition.

2. Description of the Related Art

Solid rocket motors typically include an outer case or shell housing a solid propellant grain. The rocket motor case is conventionally manufactured from a rigid, yet durable, material such as steel or filament-wound composite. The solid propellant grain is housed within the case. To protect the rocket motor case from the hot gas and particles streams generated during combustion of the solid propellant grain, solid rocket motors are also provided with a heat insulating layer (insulation) and a protective lining (liner). Typically, the insulation is bonded to the inner surface of the case. Insulated portions of the propellant are bonded to insulation and non-insulated portions of the propellant grain are bonded to the case by use of a lining layer (liner), which is typically an elastomer.

The solid propellant grain is formulated from a composition designed to combust and produce, upon discharge of the combustion products through an associated nozzle, the requisite thrust for attaining rocket motor propulsion. For example, combustion of composite solid rocket propellants generates temperatures inside the rocket motor case that can exceed 2760° C. (5,000° F.), and interior pressures may exceed 1,500 psi. These factors combine to create a high degree of turbulence for particles entrained in the gases produced during the propellant combustion.

Composite solid propellants commonly comprise a metallic fuel and chemical oxidizing agent that react with each other to release large amounts of energy and provide the interior pressures needed to attain rocket motor flight. The fuel and oxidizing agent are immobilized in a polymeric binder. Selection of an appropriate binder can enhance the tensile strength of the propellant, which is important for maintaining the structural integrity of the propellant grain during operation and storage. Other ingredients are added to the composite solid propellant, as are needed or desired, to provide additional energy performance, improve the mechanical properties of the propellant, and/or simplify processing.

Among the additional ingredients commonly found in composite solid propellants are plasticizers. In particular, nitrate ester plasticizers have found wide acceptance due to their abilities to enhance energetic performance of the propellant due their nitrate ester moieties. Nitrate ester plasticizers provided the added benefits of improving rheological properties during processing, preventing crystallization of the binder, and improving low temperature mechanical properties of the propellant. Propellants using nitrate ester plasticizers tend to react less violently during slow cook-off events, which is desirable.

For reasons explained below in connection with the following description of conventional propellants and their drawbacks and problems, it is important that a propellant containing a nitrate ester plasticizer also include a binder system that is highly compatible with the nitrate ester plasticizer. In this regard, several binder systems have been investigated for compatibility with nitrate esters.

An example of a binder system that has been investigated with nitrate ester plasticizers can be found in U.S. Pat. No. 3,004,840 to Pruitt. The Pruitt patent discloses propellants having a binder made of homopolymers of alkylene oxides having from 2 to 3 carbon atoms. The Pruitt patent provides several examples in which polyoxypropylene (also known as poly(ethylene glycol)) was tested. The Pruitt patent cites the higher oxygen content of its binders as enhancing combustion reactions. The present inventors found, however, that ethylene glycol homopolymers and propylene glycol homopolymers often exhibit poor compatibility with nitrate ester plasticizers. For example, ethylene glycol based elastomers tend to crystallize during storage unless large amounts of plasticizer are mixed with the binder. However, the large amount of plasticizer needed to avoid crystallization of poly(ethylene glycol) binders can be so great that the burn rate and shock sensitivity of the propellant can rise to unacceptable levels. On the other hand, propylene glycol homopolymers are incompatible with nitrate ester plasticizers, often causing the nitrate ester plasticizers to be exuded from the propellant so that homogeneity is not achieved.

Another example of a binder system that has been investigated with nitrate ester plasticizers can be found in U.S. Pat. No. 4,799,980 to Reed, which discloses an energetic composition having a poly(alkylene oxide) binder and a nitrate ester plasticizer. According to one embodiment of the Reed patent, a random copolymer of oxyethylene and oxypropylene is used as the binder system. However, oxyethylene present in high levels in the copolymer tends to crystallize during storage unless high levels of nitrate ester plasticizers are present. As mentioned above, high levels of nitrate ester plasticizers can unacceptably lower tensile strength and increase the sensitivity of the propellant. Higher sensitivity, especially shock sensitivity, is inconsistent with insensitive munitions requirements of many of today's propellants.

It has also been attempted to make a nitrate ester plasticized propellant comprising a mixture of poly(propylene glycol) and POLY-G®, which is a di-functional random copolymer of poly(ethylene glycol) and poly(propylene glycol) made by Olin Corporation and having a molecular weight of about 6000. The combination of POLY-G® with poly(propylene glycol) reduces the tendency of the poly (ethylene glycol) (present in the POLY-G®) to crystallize, even with low levels of plasticizers. However, this binder mixture produces a propellant that lacks adequate adhesive bonding properties to rocket motor elastomeric liners.

It would, therefore, be a significant improvement in the art to provide a poly(alkylene glycol)-based binder system that bonds well to a surrounding rocket motor elastomeric liner, does not crystallize in the absence of unacceptably high concentrations of nitrate ester plasticizer, and is sufficiently compatible with nitrate ester plasticizers so as to dissolve the plasticizers and avoid leaching out of the plasticizers during processing.

SUMMARY OF THE INVENTION

It is, therefore, an object of this invention to fulfill a long-felt need in the art by providing a nitrate ester plasticized energetic composition capable of achieving the above-discussed improvements.

In accordance with the principles of this invention, the above and other objects are attained by a nitrate ester plasticized energetic composition in which the binder comprises, prior to curing, lower alkylene glycol prepolymer blocks end-capped with at least one member selected from the group consisting of ethylene glycol monomers and ethylene glycol oligomers. The end-capped prepolymer blocks are preferably difunctional or trifunctional. As referred to herein, lower alkylene glycol means propylene glycol, butylene glycol, and/or copolymers thereof. The difunctional end-capped alkylene glycol prepolymer blocks are cured by either linking with a diisocyanate or linking and crosslinking with a polyisocyanate. In the case of a trifunctional (or higher functional) end-capped alkylene glycol prepolymer block, preferably a diisocyanate is used to effect crosslinking, since the combination of a trifunctional end-capped prepolymer and polyisocyanate can lead to excess crosslinking.

Where appropriate amounts of nitrate ester plasticizer, curative, and oxidizer, and optionally one or more of a bonding agent, stabilizer, energetic filler and additional binders are added to the binder, and the ethylene glycol end-capped alkylene glycol binder is cured with the diisocyanate and/or polyisocyanate curative, a solid propellant grain exhibiting excellent energetic performance and mechanical properties, and in particular excellent tensile strength, is obtained. Additionally, the nitrate ester plasticized energetic composition of this invention possesses excellent insensitive munitions (IM) capability, so that propellants prepared from the energetic composition tend to react less violently during slow cook-off.

It is another object of this invention to provide a method of making a nitrate ester plasticized enegetic composition.

It is still another object of this invention to provide a rocket motor assembly comprising the novel nitrate ester plasticized energetic composition.

Other objects, aspects and advantages of the invention will be apparent to those skilled in the art upon reading the specification and appended claims which, when read in conjunction with the accompanying drawing, explain the principles of this invention.

BRIEF DESCRIPTION OF THE DRAWING

The accompanying drawing is incorporated in and constitutes a part of the specification. The drawing, together with the general description given above and the detailed description of the preferred embodiments and methods given below, serve to explain the principles of the invention. In such drawing, a rocket motor assembly is illustrated in which a solid propellant comprising the nitrate ester plasticized energetic composition of this invention may be loaded.

DETAILED DESCRIPTION OF THE INVENTION

The binder system of this invention comprises, as an ingredient prior to curing, lower alkylene glycol prepolymer blocks that are end-capped with at least one member selected from the group consisting of ethylene glycol monomers and ethylene glycol oligomers. As referred to herein, lower alkylene glycol means propylene glycol and/or butylene glycol, although propylene glycol is preferred.

According to one embodiment of the invention, the lower alkylene glycol prepolymer blocks comprise difunctional prepolymer blocks comprising lower alkylene glycol prepolymers end-capped with ethylene glycol monomers and/or ethylene glycol oligomers, so that the difunctionalities are hydroxyl groups. For use in the present invention, the difunctional end-capped propylene prepolymer block preferably has an average molecular weight in a range of from about 1000 to about 6500, and more preferably about 4000. An exemplary difunctional ethylene glycol end-capped propylene prepolymer suitable for use in the present invention is made by and commercially available from BASF Corporation under the trade name HP-4000D, which is a high performance difunctional prepolymer having an average molecular weight of 4000. Other end-capped alkylene prepolymers are commercially available from sources such as Bayer Corporation.

Also within the purview of this invention is the selection of poly-functional (e.g., tri-star) end-capped lower alkylene prepolymer blocks end-capped with ethylene glycol monomers and/or ethylene glycol oligomers. A tri-functional end-capped propylene prepolymer block of the present invention preferably has an average molecular weight in a range of from about 1000 to about 8000, and more preferably about 6500. An exemplary trifunctional propylene prepolymer having ethylene glycol end caps suitable for use in the present invention is made by and commercially available from BASF Corporation under the trade name HP-6500T, which is a high performance trifunctional prepolymer having an average molecular weight of 6500. It is believed that the preparation of difunctional and polyfunctional lower alkylene glycol prepolymers end-capped with ethylene glycol is within the purview of those skilled in the art.

As referred to herein and generally understood in the art, difunctional means a compound or block having a maximum theoretical functionality of 2, but in practice typically includes compounds and blocks having actual functionalities of less than 2. Similarly, trifunctional means a compound or block having a maximum theoretical functionality of 3, but in practice typically includes compounds and blocks having actual functionalities of less than 3.

While not intending to be restricted to any theory, the applicants believe that the superior bonding characteristics and higher tensile strength of propellant binders prepared from ethylene glycol end-capped alkylene glycol blocks over propellant binders prepared from conventional poly (propylene glycol) is attributable to the difference in functionality and reactivity of the two pre-polymers. Conventional poly(propylene glycol) blocks include a much higher concentration of secondary hydroxyl groups than ethylene glycol end-capped propylene glycol prepolymer blocks. Secondary hydroxyl groups are much slower to react than primary hydroxyl groups, and, therefore, do not compete as effectively with water and other contaminants for the isocyanate curative. Additionally, end capping with ethylene glycol is believed to assist in increasing the functionality of the blocks towards their optimal theoretical functionality (e.g., 2 for a difunctional block, 3 for a trifunctional block). Replacing the secondary hydroxyl groups with the primary hydroxyl groups of the ethylene glycol end caps produces propellant having superior tensile strength and dramatically improved propellant-to-liner bonding.

Although binders prepared from lower alkylene glycols end-capped with ethylene glycol are prepared for use in the present invention, the energetic composition can comprise additional binders known in the art. Examples of hydroxy-terminated polymers that can be included as an additional binder in the energetic composition of this invention include polyethers, such as polyethylene glycol (PEG), polypropylene glycol (PPG), polybutylene oxide, poly (tetrahydrofuran), polyoxetanes, polyoxiranes (e.g., polyglycidyl nitrate (PGN) and glycidyl azide polymer (GAP)) and random or block copolymers of the above. For example, POLY G® is a random copolymer of polyethylene glycol and polypropylene glycol, made by Olin Corporation. Other elastomeric binders that can be used include hydroxy-terminated polybutadiene, acrylic acid acrylonitrile polymer; butadiene terpolymer (PBAN); and/or succinic acid triethylene glycol polymer (WITCO brand polymers). Selection of additional binders can be made, for example, to modify propellant mechanical properties (by tailoring binder functionality) and/or ballistic properties (by altering oxygen content, so that oxygen to fuel content is affected).

The total amount of binder present in the energetic composition is preferably in a range of from about 5% by weight to about 12% by weight. The amount of binder prepared from the ethylene glycol end-capped (also referred to in the art as ethylene oxide end-capped, see U.S. Pat. No. 5,067,996, column 4, lines 30–33) lower alkylene glycol blocks is preferably in a range of from about 1% by weight to about 12% by weight of the total energetic composition, more preferably from about 3 wt % to about 12 wt % of the total energetic composition.

Exemplary curatives for the binder system of the energetic composition are diisocyanate curatives and/or polyisocyanate (i.e., a compound having three or more isocyanate moieties) curatives, although a diisocyanate curative is preferably used for end-capped lower alkylene glycol blocks having functionalities of three or more. The curative can be a monomer or oligomer, so long as the curative includes at least two isocyanate moieties. Curing with a diisocyanate curative will effect chain extension of the difunctional end-capped poly(alkylene glycol) blocks, whereas curing with a polyisocyanate curative causes both chain extension and crosslinking of the end-capped poly(alkylene glycol) blocks. An especially effective polyisocyanate curative is biuret triisocyanate Desmodour curative (N-100; $C_{23}H_{38}N_6O_5$). Suitable diisocyanates include hexamethylene diisocyanate (HDI), toluene diisocyanate (TDI), isophorone diisocyanate (IPDI), dimer diisocyanate (DDI), and tetra-methyl xylene diisocyanate (TMXDI). The curing may optionally be conducted in the presence of a cure catalyst. Exemplary cure catalysts include triphenylbismuth, alkyltin compounds, including triphenyltinchloride (TPTC) and dialkyltin carboxylates, such as dibutyl tin dilaurate and dibutyl tin diacetate.

Representative nitrate ester plasticizers that can be used to plasticize the energetic composition include, by way of example, NG (nitroglycerine), TMETN (trimethylolethanetrinitrate), TEGDN (triethyleneglycoldinitrate), DEGDN (diethyleneglycol-dinitrate), PGDN (polypropyleneglycol dinitrate), EGDN (ethyleneglycol dinitrate), BTTN (butanetrioltrinitrate), alkyl NENA's (such as butyl-2-nitratoethyl-nitramine, methyl-2-nitratoethyl-nitramine, and ethyl-2-nitratoethyl-nitramine), or combinations thereof. Optionally, the energetic composition can also include one or more inert plasticizers in addition to the energetic plasticizer. Representative inert plasticizers include triacetin (glycerol triacetate; $C_9H_{14}O_6$), DOA (dioctyladipate), IDP (isodecylperlargonate), DOP (dioctylphthalate), DOM (dioctylmaleate), DBP (dibutylphthalate), di-n-propyl adipate, diethylphthalate, dipropylphthalate, citroflex, diethyl suberate, diethyl sebacate, diethyl pimelate, or combinations thereof. Generally, the weight ratio of total (energetic and non-energetic) plasticizer to total polymer (PL/PO) is not greater than 2, more preferably from 0.2 to 1.5, still more preferably about 0.5 to about 1.25 for the best mechanical properties.

The energetic composition of this invention includes one or more inorganic oxidizers, and can also optionally include one or more fuels. Representative inorganic oxidizers that can be added to the energetic composition include, by way of example, AP (ammonium perchlorate), AN (ammonium nitrate), HAN (hydroxylammonium nitrate), ADN (ammonium dinitramide), KDN (potassium dinitramide), KP (potassium perchlorate), or combinations thereof. Representative fuels include metals, such as aluminum, magnesium, boron, titanium, silicon, and alloys and/or mixtures thereof. The fuel and oxidizer may be present as powder, or in particulate or other forms. Generally, the oxidizer can comprise up to about 85% by weight of the total weight of the cured propellant. In the event that the energetic composition is used to make a solid rocket motor propellant, the metal fuel, if present, generally does not comprise more than about 25% by weight of the total weight of the cured propellant. The amount of fuel may be, and typically is, higher for explosives. The amount of oxidizer may increase closer to about 85 wt % if higher loads of metal fuels are used.

The energetic composition also preferably includes a bonding agent for bonding the oxidizer to the polymeric binder, such as by chemical reaction. An exemplary class of binding agents are di-functional or polyfunctional amines, such as TEPONAL® manufactured by 3M.

It is also preferred to include in the energetic composition one or more energetic fillers, some of which are also referred to in the art as oxidizers. Representative energetic fillers that can be used in the energetic composition include, by way of example, NQ (nitroguanidine); nitramines, such as TEX (4,10-dinitro-2,6,8,12-tetraoxa-4,10-diazatetracyclo-[$5.5.0.0^{5,9}0^{3,11}$]-dodecane), RDX (1,3,5-trinitro-1,3,5-triaza-cyclohexane), HMX (1,3,5,7-tetranitro-1,3,5,7-tetraaza-cycloocatane), and HNIW or CL-20 (2,4,6,8,10,12-hexanitro-2,4,6,8,10,12-hexaazatetracyclo-[$5.5.0.0^{5,9}0^{3,11}$]-dodecane); NTO (3-nitro-1,2,4-triazol-5-one); TATB (1,3,5-triamino-2,4,6-trinitrobenzene); and TNAZ (1,3,3-trinitroazetidine). Generally, in the event that the energetic composition is used to make a solid rocket motor propellant, the energetic solid organic fuels constitutes from about 0% by weight to about 50% by weight of the total weight of the cured propellant, more preferably not more than about 25% by weight for propellants. Higher concentrations of energetic filler are often desirable if the energetic composition is to be used for other applications requiring higher energetic performances, such as in the case of explosive devices and the like.

In the event that the energetic composition is used to make a solid propellant, the propellant formulation preferably also includes additional ingredients for improving the ballistic and mechanical properties of the propellant. Among the additional ingredients that can be included in the energetic composition are thermal stabilizers and ballistic modifiers. Representative thermal stabilizers include, by way of example, N-methyl-p-nitroaniline (MNA), ethylcentralite (sym-diethyldiphenylurea), 2-nitrodiphenyl amine (2NDPA), N-ethyl-p-nitroaniline (NENA), and/or resorcinol. These thermal stabilizers are generally added in a range of from 0.25% by weight to 1% by weight, based on the total weight of the cured propellant. Representative ballistic modifiers include titanium dioxide, lead compounds (e.g., $Pb_3O_4$,), bismuth compounds, and salts of copper, tin, and/or lead. Representative anions or chelates for the salts include oxides, citrates, nitrates, stannates, oxalates, sebacates and/or stearates. The ballistic modifier can also be a complex of beta-resorcylate, salicylate, phthlate, 4-acetoamidosalicylate, and/or 2-acetoamidobenzoate. The ballistic modifier can be present in the multi-base propellants in concentrations in a range of from about 0.5% by weight to about 2% by weight based on the total weight of the cured propellant.

Also suited for the energetic composition of this invention are reinforcing fibers. Representative reinforcing fibers include, by way of example, carbon fibers, various known polymeric fibers, such as polyethylene, polypropylene, polyesters, polyamides, polyacrylonitriles and combinations thereof. The fibers are available from commercial sources such as Mini Fibers, Inc. of Johnson City, Tenn. The fibers can be dispersed in the composition prior to casting and curing. Dispersion can be attained through conventional mixing cycles. Premixing the fibers and other solid additives in a high sheer rate blender is a particularly effective method for attaining excellent fiber dispersion. The concentration of fibers in the composition can range, by way of example, from about 0% by weight to about 2% by weight, more preferably in a range of from about 0.25% by weight to about 1% by weight, based on the total weight of the cured energetic composition. Pressure oscillation stabilizers, such as zirconium carbide and alumina, can also be used, typically in lower concentrations such as about 1% by weight of the propellant.

A method of making the energetic composition of this invention will now be described in further detail, although the energetic composition of this invention should not be considered as being limited to synthesis by this method. Generally, mixing is performed at a relatively high temperature of from about 66° C. (150° F.) to about 71° C. (160° C.). Preferably, the polymeric binder is first mixed with the inorganic oxidizer, the bonding agent (e.g., TEPANOL®), and inert plasticizer, if present. These ingredients are mixed for a suitable amount of time to permit reaction of the bonding agent with the binder and inorganic oxidizer. Optionally, mixing is performed under vacuum to remove ammonia generated during mixing. The remainder of the ingredients (with the exception of the nitrate ester plasticizer and cure catalyst) are then added, optionally at a lower temperature of, for example, about 49° C. (120° F.). Typically, the nitrate ester plasticizer is the penultimate ingredient to be added, followed by the cure catalyst. After casting, curing can be performed at an appropriate temperature, such as about 52° C. (125° F.).

Casting and curing techniques are well known in the art, and can be adapted for use with the energetic composition of this invention without undue experimentation given reference to this disclosure.

An example of a rocket motor assembly in which the energetic composition of the present invention can be used to make the solid propellant grain of the assembly is shown in the FIGURE, in which the rocket motor assembly is generally designated by reference numeral 10. The assembly 10 includes a solid propellant grain 12 loaded within the interior surface of the rocket motor case 14. Typically, insulation 16 and a liner 18 are interposed between the case 14 and the solid propellant grain 12. The insulation 16 and the liner 18 serve to protect the case from the extreme conditions produced during combustion of the solid propellant grain 12. Methods for loading a rocket motor case 14 with the insulation 16, the liner 18, and the solid propellant grain 12 are known to those skilled in the art, and can be readily adapted without undue experimentation to incorporate the propellant of this invention. Liner compositions and methods for applying liners into a rocket motor case are also well known in the art. Also shown in the FIGURE is an igniter 20 attached to the forward end of the case 14 for igniting the solid propellant grain 12 and a nozzle assembly 22 attached at the aft end of the case 14 for expelling at high velocities combustion products generated during burning of the solid propellant grain 12. For example, the liner can be an HTPB-based liner cured with dimer diisocyanate (DDI) and containing carbon black filler in amounts up to 20 wt %, CAB-O-SIL as a thickener, and TPTC cure catalyst.

The following examples are offered to further illustrate the synthesis methods of the present invention. The examples are intended to be exemplary and should not be viewed as exhaustive of the scope of the invention.

EXAMPLES

Example 1

459 grams of HP4000D were blended with 9 grams of TEPANOL® and 2024 grams of 200 $\mu$m coarse ammonium perchlorate (AP) for about 30 minutes. The blend was then mixed under vacuum for 3 hours at 68° C. (155° F.). Next, mixing was ceased and the vacuum was released. After standing for 18 hours, mixing was continued under vacuum for 3 hours while lowering the temperature from 68° C. (155° F.) to 52° C. (125° F.). Then, 366 grams of triethyleneglycoldinitrate (TEGDN), 11 grams of N-methyl-p-nitroaniline (MNA), and 0.45 grams of triphenyltinchloride (TPTC) were added sequentially to the mixture and the mixture was blended for 20 minutes at 52° C. (125° F.). Next, 363 grams of RDX were added at 52° C. (125° F.) while blending, and mixing was continued for 10 minutes. 907 grams of aluminum was then added, and mixing was continued at 52° C. (125° F.) for another 10 minutes. 357 grams of 50 $\mu$m ammonium perchlorate were added and mixed at 52° C. (125° F.) for 10 minutes. Finally, the N-100 curative in an amount of 39 grams was added to the mixture, still at 52° C. (125° F.), and mixing was continued for 1 hour under vacuum. The composition was then cast and cured.

Example 2

294 grams of HP4000D was blended with 9 grams of TEPANOL® and 1658 grams of 200 $\mu$m coarse ammonium perchlorate (AP) for about 30 minutes. The blend was then mixed under vacuum for 3 hours at 68° C. (155° F.). Next, mixing was ceased and the vacuum was released. After standing for 18 hours, mixing was continued under vacuum for 3 hours while lowering the temperature from 68° C. (155° F.) to 52° C. (125° F.). Then, 408 grams of butyl-2-nitratoethyl-nitramine (butyl-NENA), 22.7 grams of N-methyl-p-nitroaniline (MNA), and 0.9 grams of triphenyltinchloride (TPTC) were added sequentially to the mixture and the mixture was blended for 20 minutes at 52° C. (125° F.). Next, 907 grams of RDX was added while blending at 52° C. (125° F.), and mixing was continued for 10 minutes. 907 grams of aluminum were then added, and mixing was continued at 52° C. (125° F.) for another 10 minutes. 293 grams of 50 $\mu$m ammonium perchlorate were added and mixed at 52° C. (125° F.) for 10 minutes. Finally, the N-100 curative in an amount of 36 grams was added to the mixture, still at 52° C. (125° F.), and mixing was continued for 1 hour under vacuum. The composition was then cast and cured.

Example 3

234.5 grams of POLY-G® and 156.5 grams of HP4000D were blended with 9 grams of TEPANOL® and 1270 grams of 200 μm coarse ammonium perchlorate (AP) for about 30 minutes. The blend was then mixed under vacuum for 45 hours at 68° C. (155° F.). 952.5 grams of 20 μm ammonium perchlorate were added, and mixing was continued for 20 minutes without vacuum. Mixing was continued at 68° C. (155° F.) for an additional 2.25 hours, but under vacuum. After standing for 18 hours, mixing was continued under vacuum for 3 hours while lowering the temperature from 68° C. (155° F.) to 52° C. (125° F.). Then, 402 grams of triethyleneglycoldinitrate (TEGDN), 133 grams of butanetrioltrinitrate (BTTN), 22.7 grams of N-methyl-p-nitroaniline (MNA), and 0.9 grams of triphenyltinchloride (TPTC) were added sequentially to the mixture and the mixture was blended for 20 minutes at 52° C. (125° F.). Next, 317.5 grams of RDX were added at 52° C. (125° F.) while blending, and mixing was continued for 10 minutes. 45 grams of aluminum were then added, and mixing was continued at 125° F. for another 10 minutes. N-100 curative in an amount of 37.6 grams was added to the mixture, still at 52° C. (125° F.) and blending was continued for 10 minutes. Finally, 952.5 grams of 2 μm ammonium perchlorate were added and mixed at 52° C. (125° F.) for 10 minutes, followed by 2 hours of vacuum mixing at 52° C. (125° F.). The composition was then cast and cured.

The ingredients used in each of Examples 1, 2, and 3 are summarized in Table I below, in which amounts of ingredients are reported in percent by weight.

TABLE I

| | Example 1 | Example 2 | Example 3 |
|---|---|---|---|
| HP4000D | 10.12 | 6.49 | — |
| POLY-G ®/-HP4000D | — | — | 8.62 |
| TEGDN | 8.06 | — | — |
| BuNENA | — | 9.00 | — |
| TEGDN/BTTN | — | — | 11.83 |
| Al (30 μm) | 20.00 | 20.00 | 1.00 |
| RDX (2 μm) | 8.00 | 20.00 | 7.00 |
| AP (200 μm/50 μm) | 52.50 | 43.00 | — |
| AP (200 μm/20 μm/-2 μm) | — | — | 70.00 |
| TEPANOL ® | 0.20 | 0.20 | 0.20 |
| MNA | 0.25 | 0.50 | 0.50 |
| N100 | 0.86 | 0.08 | 0.83 |
| TPTC | 0.01 | 0.02 | 0.02 |

Examples 1–3 were then tested for the following mechanical properties: Young's Modulus ($E^{2.6}$ (psi)); true strain at maximum stress ($\epsilon_m^t$ (%)); true strain at maximum corrective stress ($\epsilon_m^{t,c}$ (%)); true strain at failure ($\epsilon_f^t$ (%)); maximum stress (($\sigma_m$ (psi)); and maximum corrected stress (($\sigma_m^{t,c}$ (psi)). The results of Examples 1–3 are reported below in Tables II, III, and IV, respectively.

TABLE II

| | 24° C. (75° F.) 2 ipm | −29° C. (−20° F.) 2 ipm |
|---|---|---|
| $E^{2.6}$ (psi) | 472 | 1418 |
| $\epsilon_m^t$ (%) | 54 | 92 |
| $\epsilon_m^{t,c}$ (%) | 55 | 101 |
| $\epsilon_f^t$ (%) | 56 | 104 |
| $\sigma_m$ (psi) | 99 | 235 |
| $\sigma_m^{t,c}$ (psi) | 153 | 462 |
| Shore A | 54 | |

TABLE III

| | 24° C. (75° F.) 2 ipm | −29° C. (−20° F.) 2 ipm | 63° C. (145° F.) 0.02 ipm |
|---|---|---|---|
| $E^{2.6}$ (psi) | 605 | 1997 | 308 |
| $\epsilon_m^t$ (%) | 49 | 60 | 31 |
| $\epsilon_m^{t,c}$ (%) | 49 | 67 | 31 |
| $\epsilon_f^t$ (%) | 50 | 68 | 31 |
| $\sigma_m$ (psi) | 100 | 267 | 50 |
| $\sigma_m^{t,c}$ (psi) | 149 | 435 | 65 |
| Shore A | 57 | | |

TABLE IV

| | 24° C. (75° F.) 2 ipm | 63° C. (140° F.) 0.02 ipm |
|---|---|---|
| $E^{2.6}$ (psi) | 436 | 214 |
| $\epsilon_m^t$ (%) | 50 | 31 |
| $\epsilon_m^{t,c}$ (%) | 51 | 31 |
| $\epsilon_f^t$ (%) | 51 | 31 |
| $\sigma_m$ (psi) | 153 | 54 |
| $\sigma_m^{t,c}$ (psi) | 229 | 71 |
| Shore A | 55 | |

The low temperature strain values indicate that the energetic composition has excellent elastomeric properties over a broad range of temperatures, as well as very high strain capability and tensile strength. These properties exceed even HTPB propellants in some instances, while providing a higher oxygen content than HTPB.

It was also found that a propellant comprising the energetic composition of this invention exhibited far superior bonding capabilities (90° Peel of 5.5 pli and AFT tensile adhesion at 145° F., 0.02 ipm of 53) to liners than a conventional propellant containing a poly(propylene glycol) binder (90° Peel of 0.6 pli and untestable AFT tensile adhesion).

The foregoing detailed description of the invention has been provided for the purpose of explaining the principles of the invention and its practical application, thereby enabling others skilled in the art to understand the invention for various embodiments and with various modifications as are suited to the particular use contemplated. This description is not intended to be exhaustive or to limit the invention to the precise embodiments disclosed. Modifications and equivalents will be apparent to practitioners skilled in this art and are encompassed within the spirit and scope of the appended claims.

What is claimed is:

1. A curable energetic composition comprising, as ingredients prior to cure:

at least one difunctional or polyfunctional binder comprising lower alkylene glycol prepolymer blocks end-capped with at least one member selected from the group consisting of ethylene glycol monomers and ethylene glycol oligomers, said lower alkylene glycol prepolymer blocks comprising as a lower alkylene glycol at least one member selected from the group consisting of propylene glycol and butylene glycol;

at least one curative selected from the group consisting of a diisocyanate and a polyisocyanate;

at least one nitrate ester energetic plasticizer; and at least one inorganic oxidizer.

2. The energetic composition of claim 1, wherein said alkylene glycol prepolymer blocks comprise a propylene glycol prepolymer.

3. The energetic composition of claim 1, wherein said lower alkylene glycol prepolymer block is difunctional.

4. The energetic composition of claim 1, wherein said lower alkylene glycol prepolymer block is trifunctional, and wherein said curative comprises said diisocyanate.

5. The energetic composition of claim 1, wherein said nitrate ester energetic plasticizer comprises at least one member selected from the group consisting of nitroglycerine, trimethylolethanetrinitrate, triethyleneglycoldinitrate, diethyleneglycol-dinitrate, polypropyleneglycol dinitrate, ethyleneglycol dinitrate, butanetrioltrinitrate, alkyl-2-nitratoethyl-nitramines, and combinations thereof.

6. The energetic composition of claim 1, further comprising at least one energetic filler comprising at least one member selected from the group consisting of nitroguanidine, nitramines, 3-nitro-1,2,4-triazol-5-one, 1,3,5-triamino-2,4,6-trinitrobenzene, and 1,3,3-trinitroazetidine.

7. The energetic composition of claim 1, further comprising at least one bonding agent for enhancing bonding between said binder and said inorganic oxidizer, and at least one thermal stabilizer.

8. The energetic composition of claim 7, wherein said alkylene glycol prepolymer comprises a propylene glycol prepolymer.

9. The energetic composition of claim 7, wherein said lower alkylene glycol prepolymer block is difunctional.

10. The energetic composition of claim 7, wherein said lower alkylene glycol prepolymer block is trifunctional, and wherein said curative comprises said diisocyanate.

11. A method of making an energetic composition comprising:

providing at least one binder comprising at least one difunctional or polyfunctional lower alkylene glycol prepolymer block end-capped with at least one member selected from the group consisting of ethylene glycol monomers and ethylene glycol oligomers, the lower alkylene glycol prepolymer blocks comprising as a lower alkylene glycol at least one member selected from the group consisting of propylene glycol and butylene glycol;

combining the binder with at least one inorganic oxidizer, at least one nitrate ester energetic plasticizer, and at least one curative selected from the group consisting of a diisocyanate and polyisocyanate to form a curable composition; and casting the curable composition and curing the binder with the curative.

12. The method of claim 11, wherein the alkylene glycol prepolymer comprises a propylene glycol prepolymer.

13. The method of claim 11, wherein the lower alkylene glycol prepolymer block is difunctional.

14. The method of claim 11, wherein the lower alkylene glycol prepolymer block is trifunctional, and wherein the curative comprises said diisocyanate.

15. The method of claim 11, wherein the nitrate ester energetic plasticizer comprises at least one member selected from the group consisting of nitroglycerine, trimethylolethanetrinitrate, triethyleneglycoldinitrate, diethyleneglycol-dinitrate, polypropyleneglycol dinitrate, ethyleneglycol dinitrate, butanetrioltrinitrate, alkyl-2-nitratoethyl-nitramines, and combinations thereof.

16. The method of claim 11, further comprising adding to the curable composition at least one energetic filler comprising at least one member selected from the group consisting of nitroguanidine, nitramines, 3-nitro-1,2,4-triazol-5-one, 1,3,5-triamino-2,4,6-trinitrobenzene, and 1,3,3-trinitroazetidine.

17. The method of claim 11, further comprising adding to the curable composition at least one bonding agent for enhancing bonding between said binder and said inorganic oxidizer, and at least one thermal stabilizer.

18. The method of claim 17, wherein the alkylene glycol prepolymer comprises a propylene glycol prepolymer.

19. The method of claim 17, wherein the lower alkylene glycol prepolymer block is difunctional.

20. The method of claim 17, wherein the lower alkylene glycol prepolymer block is trifunctional, and wherein the curative comprises said diisocyanate.

21. A rocket motor assembly comprising a rocket motor case, a cured rocket motor propellant loaded in said rocket motor case, and a nozzle in operative association with said rocket motor case to receive and discharge combustion products generated upon ignition of said cured rocket motor propellant, said cured rocket motor propellant comprising, as ingredients prior to cure:

at least one difunctional or polyfunctional binder comprising at least one lower alkylene glycol prepolymer block end-capped with at least one member selected from the group consisting of ethylene glycol monomers and ethylene glycol oligomers, said lower alkylene glycol prepolymer blocks comprising as a lower alkylene glycol at least one member selected from the group consisting of propylene glycol and butylene glycol;

at least one curative selected from the group consisting of a diisocyanate and polyisocyanate;

at least one nitrate ester energetic plasticizer; and at least one inorganic oxidizer.

22. The rocket motor assembly of claim 21, wherein said alkylene glycol prepolymer comprises a propylene glycol prepolymer.

23. The rocket motor assembly of claim 21, wherein said lower alkylene glycol prepolymer block is difunctional.

24. The rocket motor assembly of claim 21, wherein said lower alkylene glycol prepolymer block is trifunctional, and wherein said curative comprises said diisocyanate.

25. The rocket motor assembly of claim 21, wherein said nitrate ester energetic plasticizer comprises at least one member selected from the group consisting of nitroglycerine, trimethylolethanetrinitrate, triethyleneglycoldinitrate, diethyleneglycol-dinitrate, polypropyleneglycol dinitrate, ethyleneglycol dinitrate, butanetrioltrinitrate, alkyl-2-nitratoethyl-nitramines, and combinations thereof.

26. The rocket motor assembly of claim 21, further comprising at least one energetic filler comprising at least one member selected from the group consisting of nitroguanidine, nitramines, 3-nitro-1,2,4-triazol-5-one, 1,3,5-triamino-2,4,6-trinitrobenzene, and 1,3,3-trinitroazetidine.

27. The rocket motor assembly of claim 21, further comprising at least one bonding agent for enhancing bonding between said binder and said inorganic oxidizer, and at least one thermal stabilizer.

28. The rocket motor assembly of claim 27, wherein said alkylene glycol prepolymer comprises a propylene glycol prepolymer.

29. The rocket motor assembly of claim 27, wherein said lower alkylene glycol prepolymer block is difunctional.

30. The rocket motor assembly of claim 27, wherein said lower alkylene glycol prepolymer block is trifunctional, and wherein said curative comprises said diisocyanate.

* * * * *

UNITED STATES PATENT AND TRADEMARK OFFICE

CERTIFICATE OF CORRECTION

PATENT NO. : 6,632,378 B1 
DATED : October 14, 2003
INVENTOR(S) : Ingvar A. Wallace, II and Jeffery Oyler It is certified that error appears in the above-identified patent and that said Letters Patent is hereby corrected as shown below:

Title page,
Item [56], References Cited, U.S. PATENT DOCUMENTS, after "3,529,042" delete "*"; after "4,799,980" delete "*"; after "5,067,996" delete "*"
Item [57], ABSTRACT,
Line 6, after "glycol" change "are" to -- is --
Line 11, change "crosslinking" to -- cross-linking --

Column 1,
Line 8, change "The benefit of priority of claimed of" to -- This application claims the benefit of --
Line 24, after "particular" and before "a" insert -- to --
Line 27, delete the comma after "composition"
Line 36, change "particles" to -- particle --
Line 42, change "non-insulated" to -- noninsulated --
Line 51, change "2760" to -- 2,760 --

Column 2,
Line 5, after "due" and before "their" insert -- to --
Line 6, change "provided" to -- provide --
Line 30, change "glycol based" to -- glycol-based --
Line 58, change "di-functional" to -- difunctional --
Line 61, change "6000" to -- 6,000 --

Column 3,
Line 7, before "SUMMARY" insert -- BRIEF --
Line 8, change "It is, therefore, an object of this" to -- The present -- and change "to fulfill" to -- fulfills --
Line 12, change "principles of this" to -- present --
Line 13, change "objects" to -- advantages --
Line 21, change "lower" to -- "lower -- and change "glycol" to -- glycol"
Lines 25, 28 and 30, change "crosslinking" to -- cross-linking --
Line 41, change "insensitive munitions" to -- Insensitive Munitions --
Line 44, change "It is another object of this" to -- The present -- and change "to provide" to -- also provides --
Line 45, change "enegetic" to -- energetic --
Line 46, change "It is still another object of this" to -- The present -- and change "to provide" to -- further provides --
Line 49, delete "objects,"
Line 55, after "drawing" and before "is" insert -- figure --
Line 59, change "serve" to -- serves --

UNITED STATES PATENT AND TRADEMARK OFFICE

CERTIFICATE OF CORRECTION

PATENT NO. : 6,632,378 B1
DATED : October 14, 2003
INVENTOR(S) : Ingvar A. Wallace, II and Jeffery Oyler It is certified that error appears in the above-identified patent and that said Letters Patent is hereby corrected as shown below:

Column 4,
Line 24, change "poly-functional" to -- polyfunctional -- and change "tri-star" to -- tristar --
Line 26, change "tri-functional" to -- trifunctional --
Lines 42 and 46, insert a comma after "practice"
Line 53, after "glycol)" change "is" to -- are --
Line 54, change "pre-polymers" to -- prepolymers --
Line 59, delete the comma after "groups"

Column 5,
Line 21, change "oxygen to fuel" to -- oxygen-to-fuel --
Line 43, change "crosslinking" to -- cross-linking --

Column 6,
Line 7, change "non-energetic" to -- nonenergetic --
Line 12, delete the comma after "oxidizers"
Line 35, change "are di-functional" to -- is difunctional --
Line 45, change "cycloocatane" to -- cyclooctane --
Line 51, change "constitutes" to -- constitute --

Column 7,
Line 10, change "phthlate" to -- phthalate --
Line 12, change "multi-base" to -- multibase --
Line 50, before "then" change "are" to -- is --
Line 56, delete the comma after "art"
Line 63, change "FIGURE" to -- Figure --

Column 8,
Line 2, after "case" and before "from" insert -- 14 --
Line 6, delete the comma after "art"
Line 10, change "FIGURE" to -- Figure --
Lines 38 and 62, change "grams" to -- gram --
Line 43, before "then" change "was" to -- were --
Lines 53 and 65, change "was" to -- were --

Column 9,
Line 12, change "1270" to -- 1,270 --
Line 24, after "0.9" change "grams" to -- gram --
Line 32, insert a comma after "F.)" at the beginning of the line,

UNITED STATES PATENT AND TRADEMARK OFFICE

CERTIFICATE OF CORRECTION

PATENT NO. : 6,632,378 B1
DATED : October 14, 2003
INVENTOR(S) : Ingvar A. Wallace, II and Jeffery Oyler It is certified that error appears in the above-identified patent and that said Letters Patent is hereby corrected as shown below:

Column 11,
Lines 12 and 37, before "alkylene" insert -- lower --
Lines 15, 17, 40 and 42, change "block is" to -- blocks are --
Lines 18 and 43, after "said" and before "curative" insert -- at least one --
Line 20, before "nitrate" insert -- at least one --
Line 34, after "said" and before "binder" insert
-- at least one -- and before "inorganic" insert -- at least one --
Line 51, change “blocks” to -- block --
Line 55, before "binder" change "the" to -- said at least one --
Line 58, after "and" and before "polyisocyanate" insert -- a --
Line 60, before "curable" change "the" to -- said -- and before "binder" change "the" to -- said at least one --
Line 61, before "curative" insert -- said at least one --
Line 62, before "alkylene" change "the" to -- said at least one lower --
Lines 64 and 66, before “lower” change “the” to -- said at least one --
Line 67, after "wherein" change "the" to -- said at least one --

Column 12,
Line 1, before "nitrate" change "the" to -- said at least one --
Lines 9 and 15, before "curable" change "the" to -- said --
Line 16 and 67, after "said" (both occurrences) insert -- at least one --
Line 18, before "alkylene" change "the" to -- said at least one lower --
Lines 20 and 22, before "lower" change "the" to -- said at least one --
Line 23, after "wherein" change "the" to -- said at least one --
Line 36, after "said" and before "lower" insert -- at least one --
Line 37, change "blocks" to -- block --
Line 41, after "and" and before "polyisocyanate" insert -- a --
Line 44, at the end of the line, after "said" insert -- at least one lower --
Lines 47, 49 and 52 at the end of the line, after "said" insert
-- at least one --
Line 51, after "said" and before "curative" insert
-- at least one --

Column 13,
Line 1, at the end of the line, after "said" insert -- at least one lower --
Line 4, at the end of the line, after "said" insert -- at least one --

UNITED STATES PATENT AND TRADEMARK OFFICE

CERTIFICATE OF CORRECTION

PATENT NO. : 6,632,378 B1 
DATED : October 14, 2003
INVENTOR(S) : Ingvar A. Wallace, II and Jeffery Oyler It is certified that error appears in the above-identified patent and that said Letters Patent is hereby corrected as shown below:

Column 14,
Line 1, at the end of the line, after "said" insert -- at least one --
Line 3, after "said" and before "curative" insert -- at least one --

Signed and Sealed this

Eighth Day of February, 2005

JON W. DUDAS
*Director of the United States Patent and Trademark Office*